United States Patent [19]

Nava

[11] Patent Number: 4,704,746

[45] Date of Patent: Nov. 10, 1987

[54] INTEGRAL HELMET

[75] Inventor: Pier L. Nava, Bergamo, Italy

[73] Assignee: Nava & C.S.P.A., Verderio Superiore, Italy

[21] Appl. No.: 792,469

[22] Filed: Oct. 29, 1985

[30] Foreign Application Priority Data

Nov. 22, 1984 [IT] Italy ..... 23693 A/84

[51] Int. Cl.[4] ..... A42B 3/00

[52] U.S. Cl. ..... 2/424; 2/425; 2/436; 2/171.3; 2/184.5

[58] Field of Search ..... 2/425, 424, 410, 6, 2/171.3, 10, 184.5, 436, 437, 411

[56] References Cited

U.S. PATENT DOCUMENTS

| | | | |
|---|---|---|---|
| 654,432 | 7/1900 | Borrow et al. | 2/184.5 X |
| 707,486 | 8/1902 | Wolbrecht | 2/184.5 X |
| 4,101,980 | 7/1978 | Stepan et al. | 2/424 X |
| 4,434,514 | 3/1984 | Sundahl et al. | 2/424 X |
| 4,519,099 | 5/1985 | Kamiya et al. | 2/424 |
| 4,538,303 | 9/1985 | Schnitzler | 2/424 |
| 4,553,270 | 11/1985 | Hoffmann | 2/424 X |
| 4,555,816 | 12/1985 | Broersma | 2/171.3 X |
| 4,581,774 | 4/1986 | Chaise | 2/424 X |
| 4,612,675 | 9/1986 | Broersma | 2/425 X |
| 4,622,700 | 11/1986 | Sundahl | 2/425 |
| 4,653,123 | 3/1987 | Broersma | 2/425 |

FOREIGN PATENT DOCUMENTS

| | | | |
|---|---|---|---|
| 0697175 | 9/1940 | Fed. Rep. of Germany | 2/424 |
| 3316920 | 11/1984 | Fed. Rep. of Germany | 2/410 |
| 3344706 | 6/1985 | Fed. Rep. of Germany | 2/410 |

*Primary Examiner*—Peter Nerbun

*Attorney, Agent, or Firm*—Ladas & Parry

[57] ABSTRACT

The chin piece of a helmet (A) having a visor has a horizontal channel to convey air from apertures to the interior of the helmet and, specifically, to strike the inner surface of the visor to avoid fogging of the visor. The helmet also has side intercepting elements. Each intercepting element is a rotating non-projecting cap to convey air into or from the interior of helmet or to close air communication. An aperture in the top of the helmet increases air circulation and is covered for suction discharge of air to the exterior.

4 Claims, 4 Drawing Figures

INTEGRAL HELMET

DESCRIPTION

This invention relates to an integral helmet. The purpose of the invention is to realize a protective helmet especially suited for sports use ventilation and aeration in any season to avoid causing discomfort to the wearer. In particular, the scope of the invention is to ensure constant and efficient ventilation of the helmet at all times, both in hot and cold seasons.

The integral helmet according to the invention, the padding of which contemplates channels in which circulates the ventilating air, is characterized in that the circulation of the air in the helmet is conceived so that air enters through the inlets in the lower lateral part of the helmet, circulates in the interior, and is partly discharged, also through the apertures provided on the top of the helmet. In this manner, air circulation is much improved, also due to the aspirating action produced when the vehicle is running.

The invention will now be explained in the following description, with reference to the annexed drawings which are given only by way of example, and are not limitative for the extent of the invention.

Figure 1:
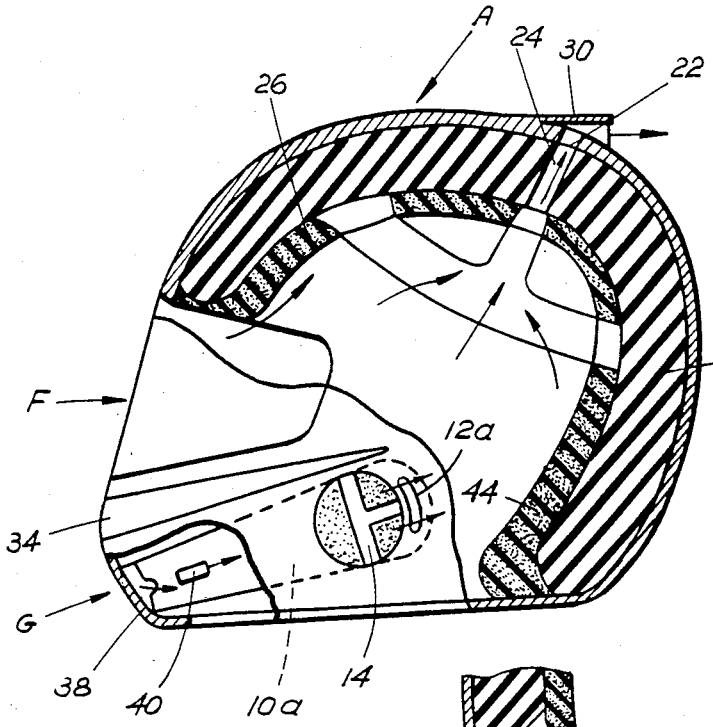
FIG. 1 shows a cross section of a helmet suited for the winter season.

With reference to FIGS. 1 thru 4, letter A designates the integral helmet and letter B the internal part provided with padding for example foamed resin apt to absorb shock; letter C designates the internal lining formed by open cell type foam resin; said lining forms, together with the padding, channels for circulation of the ventilating air, as will now be demonstrated.

In the case under consideration, i.e. in the case of FIGS. 1 thru 4, the ventilating air for helmet A enters conduits 10 and 12 through relevant terminal apertures in the helmet, which communicate with the exterior through maneuverable cap-shaped intercepting devices 14, retained suitably on the side of the helmet, for example. Each cap 14 is retained on helmet A, at a point near its lower side walls so that it may rotate. Cap 14 is so shaped that each may cooperate with the apertures of conduits 10 and 12 to establish the desired communication, in relation to the angular positions assumed.

More specifically, when cap 14 is in the position shown in FIG. 3, conduit 12 is closed and the external air enters through adjustable aperture 20, to flow subsequently from the interior of said cap 14 and the aperture of conduit 10 to the interior of the helmet.

When cap 14 is rotated to approx. 180° (see FIG. 4) and is struck by the running wind, a suction is produced at aperture 20 and the air outlets from conduit 10 of the helmet, while conduit 12 is closed by cap 14.

It is evident that by suitably positioning cap 14 in conduits 10 and 12 so that the former assumes different angular positions, it is possible to obtain, in addition to the two mentioned conditions, also two further connections of said apertures, that is, reciprocal connection in series of apertures 10 and 12 or the interception of both.

In order to achieve a complete and satisfactory ventilation of the helmet, especially in the hot season, said helmet A is provided, in its top central part, with apertures 22 which connect the exterior of the helmet with the interior, especially with a top channel 24 which communicates with said upper apertures 22 and which connect, through other channels 26 in the helmet's padding, and with the lower apertures communicating with conduits 10 and 12. Apertures 22 in the upper part of helmet A are protected against weather conditions by a shaped covering 30 which also facilitates conveying, avoiding turbulence, of the air which discharges from the helmet through the rear of the aperture cover, especially during forward motion of the vehicle, i.e. helmet, and also during stops, owing to their position.

On the other hand, top apertures 22 facilitate suction and discharge of the air from the inside of helmet A.

Specifically, a part of top channels 24 connects with one or more front channels 32 which outlet at a point or substantially at a point in the lower part of visor (F) of the helmet. In this way ventilation of the inner front zone of helmet A is made possible, to avoid fogging of said visor.

Moreover, top apertures 22 and front channels 32, which outlet opposite or in the proximity of visor F draw in the air at the base of said visor.

A chin piece G of the integral helmet A shown, is provided, in the proximity of its top edge and in the proximity of the lower edge of visor F with top apertures 34 terminating in a slot 36 in the lower part of the aperture of said visor F and provided in the helmet. A laminar flow of air is thus created, which strikes the inner face of visor F, thereby to limit and avoid fogging. Apertures 34 of chin piece G can be provided with flaps or similar devices to control the inflowing air which strikes the inner surface of visor F.

Figure 2:
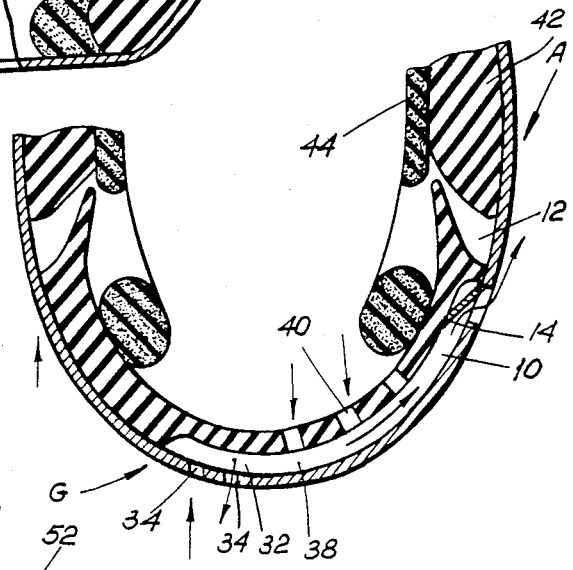
FIG. 2 is a horizontal cross section according to FIG. 1, taken on two different planes

The chin piece G of the helmet shown is provided, in its lower part, with a horizontal channel 38, the ends of which connect with the apertures 10 already considered with reference to FIGS. 2 through 4 governed by caps 14 as described with reference thereto. Channel 38 communicates with the interior of helmet A through internal apertures 40 and which are provided, advantageously in padding 42 and/or in lining 44 of helmet A.

Figure 4:
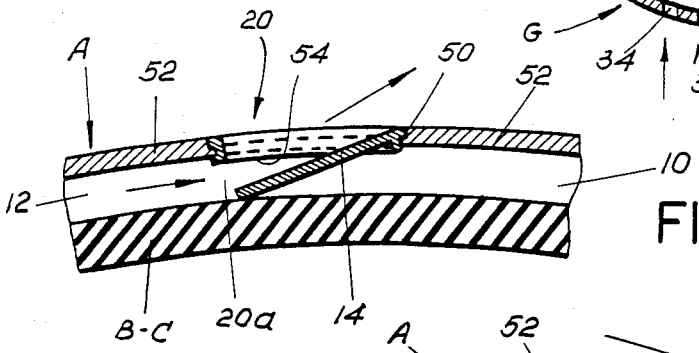
FIGS 3 and 4 are cross sections of a portion of the helmet.
Figure 3:
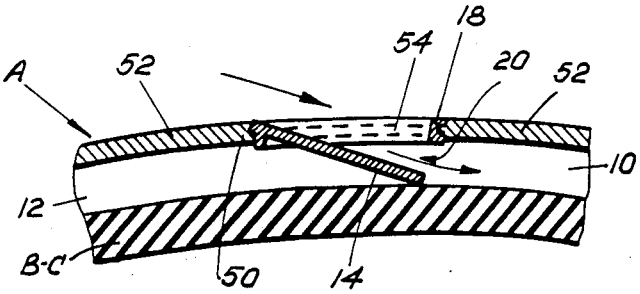

FIGS. 3 and 4 show devices 14 advantageously embedded so as not to have any parts projecting from the outer surface of helmet A. Each of said devices is formed by a disc having, at its periphery or base 18, a groove 50 engaging a corresponding seat on each wall 52 of helmet A.

The middle part of disc 54 is provided with a diametral aperture 54, the bottom of which is suitably inclined and terminates, in proximity of its edge, with an aperture 20. The aperture can be oriented, along the axis of channel 12, in one direction or in the opposite direction. Aperture 54 can also be set at 90° with resepct to the axis of the channel, depending on requirements.

In the first case, the air flowing through channel 10 and the external air drawn from aperture 54 is introduced in said channel in that shifting of helmet A creates a certain vacuum in the channel itself, which, through aperture 20, draws in air from the exterior. In the second case the air present in channel 12, upstream of disc enters in aperture 20 and discharges to the exterior of helmet A, i.e. from the helmet.

On the other hand, when the disc is rotated by 90° with respect to the two positions just considered, communication between upstream and downstream of channels 10, is intercepted, thereby closing communication of said channel, i.e. the interior of the helmet with the exterior.

The achievement of the scopes of the present invention is thus confirmed, i.e. to ventilate the interior of the helmet rationally and satisfactorily, at the different climatic conditions required from time to time.

Furthermore, the helmet may also be provided with air intakes located in front, apt to provide a laminar air flow on visor F. The inner padding 42 of cellular structure may be of the large cell type, to ensure the desired ventilation of the helmet.

It is understood that modifications and variants may be introduced in the invention without departing from the domain of the patent invention.

What is claimed is:

1. A helmet comprising:

an integral helmet (A) having a visor (F) on one front side;

a shock absorber liner (42) inside the helmet;

a comfort padding (44) inside the shock absorber liner;

an opening (34) for air inflow into the helmet through the one front side of the helmet;

at least one conduit opening (10*a*, 12*a*) at each side of the helmet lateral of the one, front side for ventilating air for the helmet;

at least one upper aperture (22) through a top of the helmet for discharging air from the helmet, whereby, owing to the top position, to facilitate such air discharge when the helmet is not moving relative to the ambient air; and covering means (30) covering the at least one upper aperture relative to the helmet for protecting the at least one upper aperture from weather, the covering means (30) also being shaped for discharging air from inside the helmet through the at least one upper aperture by suction through the rear of the covering means relative to the one front side of the helmet during forward motion of the helmet relative to the one front side thereof.

2. The helmet as defined in claim 1, wherein the at least one upper aperture (22) is in the top central part of the helmet.

3. The helmet as defined in claim 1, and further comprising a channel (26) in the comfort padding and a top channel (24) communicating with the at least one upper aperture and connecting to the channel for ventilation in cooperation with at least one of the openings.

4. The helmet as defined in claim 1, and further comprising disc means (14*a*) in each of the at least one conduit openings embedded in the helmet so as not to have any part projecting from an outer surface of the helmet and rotatable for drawing and discharging air into and from the helmet and for closing communication between the exterior and the interior of the helmet.

* * * * *